US010167127B2

(12) United States Patent
Oguchi

(10) Patent No.: US 10,167,127 B2
(45) Date of Patent: Jan. 1, 2019

(54) CYLINDRICAL BOTTLE WITH BOTTOM

(71) Applicant: Hiroki Oguchi, Tokyo (JP)

(72) Inventor: Hiroki Oguchi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 75 days.

(21) Appl. No.: 15/304,343

(22) PCT Filed: Feb. 12, 2015

(86) PCT No.: PCT/JP2015/053795
§ 371 (c)(1),
(2) Date: Oct. 14, 2016

(87) PCT Pub. No.: WO2015/166682
PCT Pub. Date: Nov. 5, 2015

(65) Prior Publication Data

US 2017/0036803 A1 Feb. 9, 2017

(30) Foreign Application Priority Data

Apr. 30, 2014 (JP) ..... 2014-093353

(51) Int. Cl.
*B65D 79/00* (2006.01)
*B65D 90/36* (2006.01)
(Continued)

(52) U.S. Cl.
CPC ..... *B65D 79/005* (2013.01); *B65D 1/02* (2013.01); *B65D 1/0276* (2013.01); *B65D 1/44* (2013.01);
(Continued)

(58) Field of Classification Search
CPC ..... B65D 90/36; B65D 79/005
See application file for complete search history.

(56) References Cited

U.S. PATENT DOCUMENTS 4,174,782 A 11/1979 Obsomer
2004/0094502 A1 5/2004 Boukobza
(Continued)

FOREIGN PATENT DOCUMENTS

JP S60-182309 U 12/1985
JP H01-99949 A 4/1989
(Continued)

OTHER PUBLICATIONS

Nov. 22, 2017 extended Search Report issued in European Patent Application No. 15786067.7.
(Continued)

*Primary Examiner* — Jeffrey Allen
*Assistant Examiner* — Jennifer Castriotta
(74) *Attorney, Agent, or Firm* — Oliff PLC

(57) ABSTRACT

A bottle includes a bottom wall portion of a bottom portion, grounding portion at an outer circumferential edge, rising circumferential wall portion continuous with grounding portion from the bottle radial inner side, and movable wall portion protrudes from the rising circumferential wall portion upper end. The movable wall portion movable upward around a connected portion to the rising circumferential wall portion. Plurality of ribs are radially disposed around bottle axis on the movable wall portion, and ribs include main recess that is recessed upward, and connection recess. Plurality of main recesses arranged at predetermined intervals in the bottle radial direction, and connection recess connects main recesses, adjacent to each other in the bottle radial direction, in the bottle radial direction together. A depth ratio D2/D1 that is the ratio of a depth (D2) of the connection recess to a depth (D1) of each main recess <2/9 and ≥1.

2 Claims, 5 Drawing Sheets

(51) Int. Cl.

| | |
|---|---|
| ***B65D 1/02*** | (2006.01) |
| ***B65D 41/00*** | (2006.01) |
| ***B65D 1/44*** | (2006.01) |

(52) U.S. Cl.
CPC ..... *B65D 41/00* (2013.01); *B65D 90/36* (2013.01); *B65D 2501/0036* (2013.01)

(56) References Cited

U.S. PATENT DOCUMENTS

| | | | | |
|---|---|---|---|---|
| 2009/0159556 | A1* | 6/2009 | Patcheak ..... | B65D 1/0276 215/373 |
| 2011/0309090 | A1 | 12/2011 | Derrien et al. | |
| 2013/0180998 | A1 | 7/2013 | Nakayama et al. | |
| 2015/0041426 | A1 | 2/2015 | Oguchi et al. | |

FOREIGN PATENT DOCUMENTS

| | | | |
|---|---|---|---|
| JP | 2002-370721 | A | 12/2002 |
| JP | 2004-524236 | A | 8/2004 |
| JP | 2010-500241 | A | 1/2010 |
| JP | 2012-091860 | A | 5/2012 |
| JP | 2013-079096 | A | 5/2013 |
| JP | 2013-180756 | A | 9/2013 |
| LU | 77042 | A1 | 11/1978 |
| WO | 2013/129480 | A1 | 9/2013 |

OTHER PUBLICATIONS

May 19, 2015 International Search Report issued in International Patent Application No. PCT/JP2015/053795.
Aug. 24, 2017 Office Action issued in Chinese Patent Application No. 2015800226481.

* cited by examiner

CYLINDRICAL BOTTLE WITH BOTTOM

TECHNICAL FIELD

The present invention relates to a bottle.

Priority is claimed on Japanese Patent Application No. 2014-093353, filed Apr. 30, 2014, the content of which is incorporated herein by reference.

BACKGROUND ART

Conventionally, for example, a configuration as shown in the following Patent Document 1 is known as a bottle formed in a bottomed cylindrical shape using a synthetic resin material. In this bottle, a bottom wall portion of a bottom portion includes a grounding portion located at an outer circumferential edge; a rising circumferential wall portion that is continuous with the grounding portion from a radial inner side of the bottle and extends upward; and a movable wall portion that protrudes from an upper end of the rising circumferential wall portion toward a radial inner side of the bottle. In this bottle, the movable wall portion turns upward and moves rotationally around a connected portion to the rising circumferential wall portion, thereby absorbing decompression within the bottle.

CITATION LIST

Patent Document

[Patent Document 1] Japanese Unexamined Patent Application, First Publication No. 2012-91860

SUMMARY OF INVENTION

Technical Problem

However, in the above related-art bottle, there is room for improvement in improving the pressure reduction-absorbing performance within the bottle.

The invention has been made in view of the aforementioned circumstances, and an object thereof is to improve the pressure reduction-absorbing performance within a bottle.

Solution to Problem

In order to solve the above problems, the invention suggests the following means.

The bottle related to the invention is a bottle formed of a synthetic resin material in a bottomed cylindrical shape, including a bottom wall portion of a bottom portion that includes a grounding portion located at an outer circumferential edge, a rising circumferential wall portion that is continuous with the grounding portion from a radial inner side of the bottle and extends upward, and a movable wall portion that protrudes from an upper end of the rising circumferential wall portion toward a radial inner side of the bottle. The movable wall portion is disposed to be movable upward around a connected portion to the rising circumferential wall portion. A plurality of ribs are radially disposed around a bottle axis on the movable wall portion. The ribs include a main recess that is recessed upward, and a connection recess, and a plurality of the main recesses are arranged at predetermined intervals in the radial direction of the bottle. The connection recess connects main recesses, which are adjacent to each other in the radial direction of the bottle, in the radial direction of the bottle together. A depth ratio D2/D1 that is the ratio of a depth D2 of the connection recess to a depth D1 of each main recess is greater than 2/9 and equal to or smaller than 1.

In this case, the depth ratio D2/D1 is made greater than 2/9 and equal to or smaller than 1. Accordingly, it is possible to secure a large upward movement distance of the movable wall portion at the time of decompression within the bottle. Consequently, the pressure reduction-absorbing performance within the bottle can be improved. That is, in a case where the depth ratio D2/D1 is equal to or smaller than 2/9, it may become difficult to greatly displace the movable wall portion in the direction of the bottle axis at the time of decompression within the bottle. In addition, in such a configuration in which the movable wall portion gradually extends downward from the radial outer side of the bottle toward the radial inner side thereof, in a case where the depth ratio D2/D1 is made greater than 2/9 and equal to or smaller than 1, the movable wall portion can be greatly deformed in the direction of the bottle axis at the time of decompression within the bottle, for example, the movable wall portion can be deformed into a reversed state in the direction of the bottle axis.

The depth ratio D2/D1 may be smaller than 1.

In this case, the main recess can be formed more deeply than the connection recess. Accordingly, when the inside of the bottle is brought into a decompressed state, the movable wall portion can be effectively moved upward so that the pressure reduction-absorbing performance within the bottle is further improved.

The depth ratio D2/D1 may be equal to or greater than 2.5/9 and equal to or smaller than 5/9.

In this case, the movable wall portion can be more effectively moved upward so that the pressure reduction-absorbing performance within the bottle is reliably improved.

Advantageous Effects of Invention

According to the invention, the pressure reduction-absorbing performance within the bottle can be improved.

DESCRIPTION OF EMBODIMENTS

Figure 1:
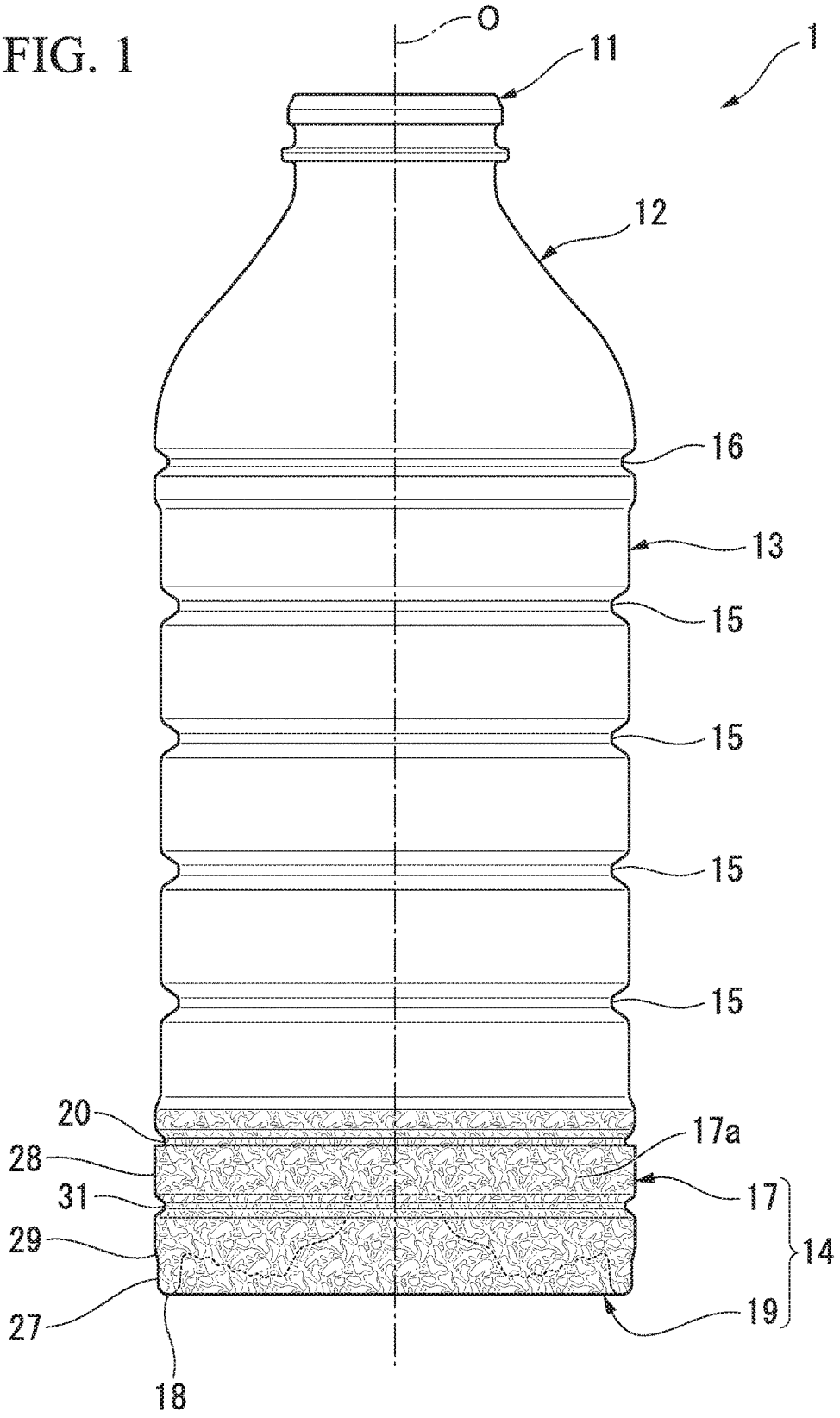
FIG. 1 is a side view of a bottle in an embodiment of the invention.

Hereinafter, a bottle related to an embodiment of the invention will be described with reference to the drawings.

A bottle 1 related to the present embodiment, as shown in FIGS. 1 to 4, includes a mouth portion 11, a shoulder portion 12, a body portion 13, and a bottom portion 14, and has a schematic configuration in which these portions 11 to 14 are continuously provided in this order in a state where central axes thereof are located a common axis.

Hereinafter, the common axis is referred to as a bottle axis O, and a mouth portion 11 side in the direction of the bottle axis O is referred to as an upper side, and a bottom portion 14 side in the direction of the bottle axis O is referred to as a lower side. In a plan view when the bottle 1 is seen from the direction of the bottle axis O, a direction orthogonal to the bottle axis O is referred to as a radial direction (a radial direction of the bottle), and a direction going around the bottle axis O is referred to as a circumferential direction.

The bottle 1 is formed by blow-molding a preform formed in a bottomed cylindrical shape through injection molding, and is integrally formed of a synthetic resin material. A cap (not shown) is mounted on the mouth portion 11. The shapes of the mouth portion 11, the shoulder portion 12, the body portion 13, and the bottom portion 14 in horizontal sectional views orthogonal to the bottle axis O are circular shapes.

A first annular groove 16 is continuously formed over the entire circumference at a connected portion between the shoulder portion 12 and the body portion 13.

The body portion 13 is formed in a tubular shape, and is formed to have a smaller diameter than both ends in the direction of the bottle axis O between both the ends. A plurality of second annular grooves 15 are continuously formed over the entire circumference at predetermined intervals in the direction of the bottle axis O in the body portion 13.

A third annular groove 20 is continuously formed over the entire circumference at a connected portion between the body portion 13 and the bottom portion 14.

The bottom portion 14 is formed in the shape of a cup including a heel portion 17 having an upper opening section connected to a lower opening section of the body portion 13, and a bottom wall portion 19 that closes a lower opening section of the heel portion 17 and has an outer circumferential edge used as a grounding portion 18.

A fourth annular groove 31 with the same depth as that of the third annular groove 20 is continuously formed over the entire circumference in the heel portion 17. A lower heel edge portion 27 of the heel portion 17 that is continuous with the grounding portion 18 from a radial outer side is formed to have a smaller diameter than an upper heel portion 28 that is continuous with the lower heel edge portion 27 from above and has the fourth annular groove 31 formed therein. A coupling portion 29 between the lower heel edge portion 27 and an upper heel portion 28 is gradually reduced in diameter downward from above. In addition, the upper heel portion 28 becomes a maximum external diameter portion of the bottle 1, together with both ends of the body portion 13 in the direction of the bottle axis O.

An uneven portion 17*a* is formed in an outer peripheral surface of the heel portion 17 and an outer peripheral surface of a lower end of the body portion 13. Accordingly, in a filling step, when a number of bottles 1 are made to stand side by side and are conveyed, a situation in which the outer peripheral surfaces of the heel portions 17 and the outer peripheral surfaces of the lower ends of the body portions 13 in the bottles 1 adjacent to each other are brought into close contact with each other and do not easily slide on each other is prevented, and occurrence of so-called blocking is suppressed. In addition, the uneven portion 17*a* is also formed in the surface of the third annular groove 20 and the surface of the fourth annular groove 31 in a shown example.

Figure 3:
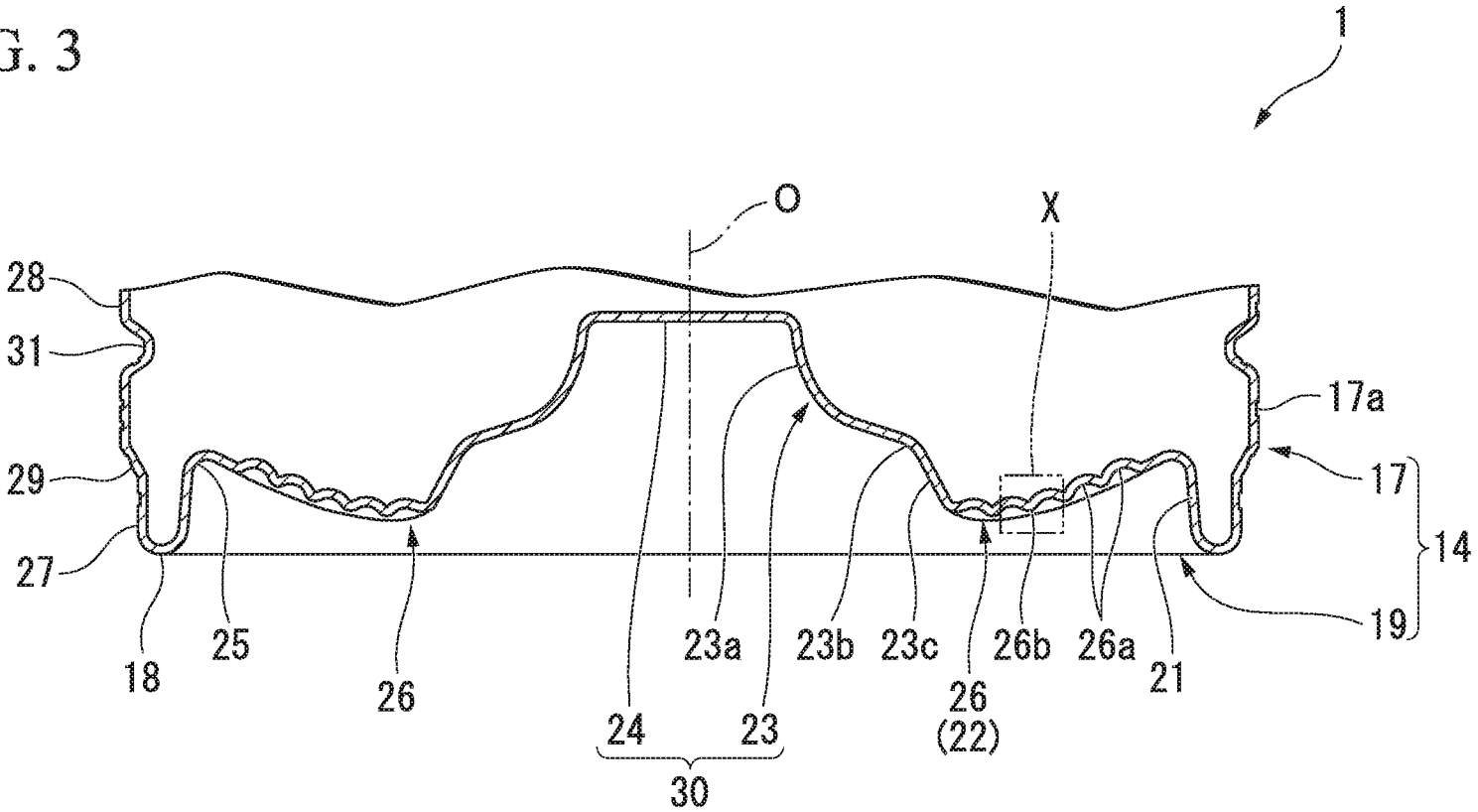
FIG. 3 is a sectional view when seen from arrow A-A of FIG. 2.

The bottom wall portion 19, as shown in FIG. 3, includes a rising circumferential wall portion 21 that is continuous with the grounding portion 18 from a radial inner side and extends upward, an annular movable wall portion 22 that protrudes toward the radial inner side from an upper end of the rising circumferential wall portion 21, and a bottom central portion 30 that is continuous with a radial inner end of the movable wall portion 22. The movable wall portion 22 and the bottom central portion 30 are arranged on the radial inner side of the rising circumferential wall portion 21, and close an upper opening section of the rising circumferential wall portion 21.

The rising circumferential wall portion 21 is gradually reduced in diameter downward from below.

The movable wall portion 22 is formed in the shape of a curved surface part that protrudes downward, and gradually extends downward from a radial outer side toward the radial inner side. The movable wall portion 22 and the rising circumferential wall portion 21 are coupled together via the curved surface part 25 that protrudes upward. The movable wall portion 22 moves rotationally around the curved surface part (a connected portion thereof to the rising circumferential wall portion) 25 so that a recessed circumferential wall portion 23 is moved upward.

The bottom central portion 30 is arranged on the bottle axis O, and is located on the radial inner side of the movable wall portion 22. The bottom central portion 30 closes an opening formed on the radial inner side of the movable wall portion 22 by the radial inner end of the movable wall portion 22. The portion of the bottom central portion 30 located on the bottle axis O is located above the radial inner end of the movable wall portion 22. The bottom central portion 30 in the present embodiment includes the recessed circumferential wall portion 23 that extends upward from the radial inner end of the movable wall portion 22, and a top wall 24 that is arranged coaxially with the bottle axis O at an upper end of the recessed circumferential wall portion 23.

The recessed circumferential wall portion 23 is disposed coaxially with the bottle axis O, and is gradually increased in diameter downward from above. The top wall 24 is connected to the upper end of the recessed circumferential wall portion 23, and the recessed circumferential wall portion 23 and the top wall 24 form a topped tubular shape altogether. The recessed circumferential wall portion 23 is formed in a circular shape in a cross-sectional view. The top wall 24 is formed in the shape of a disk that is arranged coaxially with the bottle axis O.

The recessed circumferential wall portion 23 includes a curved wall 23*a* that is formed in the shape of a curved surface part that protrudes toward the radial inner side, and an inclined wall 23*c* that is gradually increased in diameter downward from above. An upper end of the curved wall 23*a* is continuously provided at the top wall 24. A lower end of the curved wall 23*a* is continuously provided at the inclined wall 23*c* via a bent part 23*b*. A lower end of the inclined wall 23*c* is continuously provided at a radial inner end of the annular movable wall portion 22.

Figure 2:
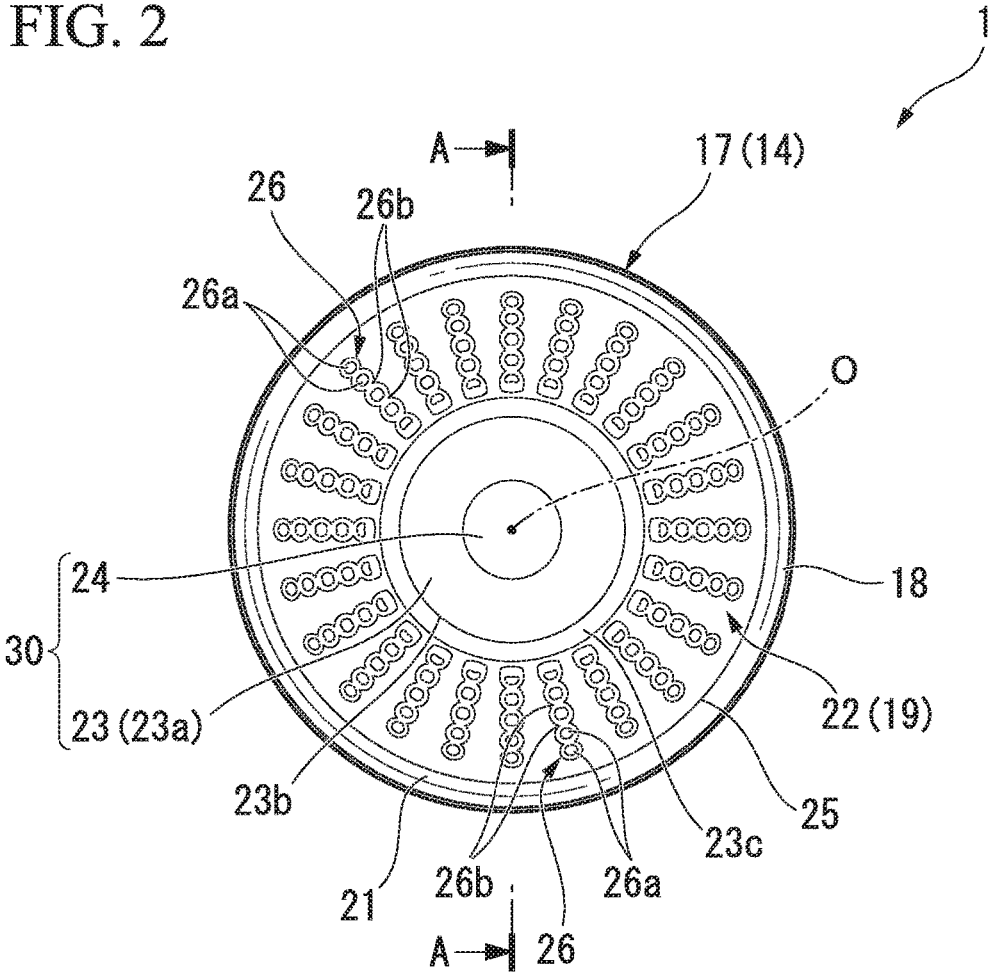
FIG. 2 is a bottom plan view of the bottle shown in FIG. 1.

As shown in FIG. 2, a plurality of ribs 26 are radially disposed in the movable wall portion 22 around the bottle axis O. Each rib 26 extends straight in the radial direction. The plurality of ribs 26 are disposed at equal intervals in the circumferential direction. In the present embodiment, the ribs 26 are arranged to be limited in the movable wall portion 22, and are arranged so as to surround the bottom central portion 30 from the radial outer side in a plan view.

Each rib 26 includes a main recess 26*a* and a connection recess 26*b* that are recessed upward from the movable wall portion 22.

Figure 4:
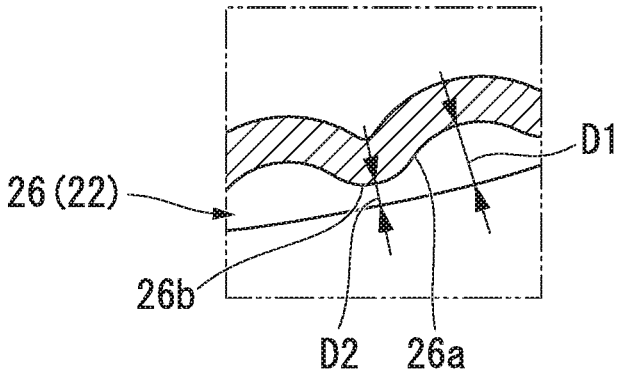
FIG. 4 is an enlarged view of an X portion shown in FIG. 3.

As shown in FIGS. 3 and 4, a plurality of (five in an shown example) the main recesses 26*a* are arranged at predetermined intervals in the radial direction. An inner surface of each main recess 26*a* is formed in the shape of a spherical surface that becomes convex toward the upper side.

Each connection recess 26*b* connects the main recesses 26*a*, which are adjacent to each other in the radial direction, in the radial direction together. An inner surface of the connection recess 26*b* is formed in the shape of a convex surface that becomes convex toward the lower side, in a vertical sectional view of the bottle 1 passing through the rib 26. In the vertical sectional view, the inner surface of the main recess 26*a* smoothly connects the inner surfaces of the connection recesses 26*b*, which are adjacent to each other in the radial direction, in the radial direction together without any step. Accordingly, the rib 26 is formed in a waveform that becomes alternately convex in the direction of the bottle axis O in the vertical sectional view.

The respective main recesses 26*a* are formed in the same shape with the same size, respectively, and are arranged at equal intervals in the radial direction. In the plurality of ribs 26, respective positions in the radial direction where the plurality of main recesses 26*a* are disposed are equal to each other. The respective connection recesses 26*b* are formed in the same shape with the same size, respectively, and are arranged at equal intervals in the radial direction. In the plurality of ribs 26, respective positions in the radial direction where the plurality of connection recesses 26*b* are disposed are equal to each other.

In the present embodiment, a depth ratio D2/D1 that is a ratio of a depth D2 of each connection recess 26*b* to a depth D1 of each main recess 26*a* is greater than 2/9 and equal to or smaller than 1. Moreover, in a shown example, the depth ratio D2/D1 is smaller than 1, and more specifically, the depth ratio D2/D1 is equal to or greater than 2.5/9 and equal to or smaller than 5/9.

If the inside of the bottle 1 configured in this way is brought into a decompressed state, the movable wall portion 22 turns upward and moves rotationally around the curved surface part 25 of the bottom wall portion 19, and thereby, the movable wall portion 22 moves so as to lift the recessed circumferential wall portion 23 (bottom central portion 30) upward. That is, an internal pressure change (decompression) of the bottle 1 can be absorbed without being accompanied by deformation of the body portion 13 or the like by deforming the bottom wall portion 19 of the bottle 1 positively at the time of decompression.

In addition, in the present embodiment, since the connected portion between the rising circumferential wall portion 21 and the movable wall portion 22 is formed in the curved surface part 25 that protrudes upward, the movable wall portion 22 can be easily moved (moved rotationally) around the upper end of the rising circumferential wall portion 21. Additionally, since the plurality of ribs 26 are formed in the movable wall portion 22 of the bottom wall portion 19 and the surface area of the movable wall portion 22 is increased, the pressure-receiving area in the movable wall portion 22 can be increased, and the movable wall portion 22 can be deformed in rapid response to the internal pressure change of the bottle 1.

Here, the present inventor found that the pressure reduction-absorbing performance within the bottle 1 can be improved by adjusting the aforementioned depth ratio D2/D1, as a result of earnest investigation. In finding this knowledge, the present inventor analyzed the pressure reduction-absorbing performance in a plurality of bottles 1 of which the depth ratios D2/D1 are made different from each other.

In the present analysis, nine types of bottles 1 of Comparative Examples 1 to 3 and Examples 1 to-6 were targeted. All of the bottles 1 have the same configuration as the above embodiment except for the form of the ribs 26, and are bottles 1 in which internal capacity is 350 ml, bottle height is 155.58 mm, bottle diameter is 66 mm, and weight is 21 g.

In the respective bottles 1 of Comparative Examples 1 to 3 and Examples 1 to 6, as shown in the following table 1, the forms of the ribs 26 was made different from each other. In addition, analysis results are also written in Table 1.

TABLE 1

| | Comparative Example 1 | Comparative Example 2 | Comparative Example 3 | Example 1 | Example 2 | Example 3 | Example 4 | Example 5 | Example 6 |
|---|---|---|---|---|---|---|---|---|---|
| Depth of Main recess (mm) | 0 | 0.9 | 0.9 | 0.9 | 0.9 | 0.9 | 0.9 | 0.9 | 0.9 |
| Depth of Connection recess (mm) | 0 | 0 | 0.2 | 0.25 | 0.3 | 0.4 | 0.5 | 0.6 | 0.9 |
| Depth Ratio D2/D1 (%) | — | 0.0 | 22.2 | 27.8 | 33.3 | 44.4 | 55.6 | 66.7 | 100.0 |
| Amount of Displacement of Center of Bottom Wall Portion (mm) | 2.6 | 3.4 | 4.5 | 7.12 | 7.1 | 6.6 | 6.2 | 5.7 | 5.1 |
| Absorbing Capacity (ml) | 4.15 | 5.68 | 7.69 | 12.44 | 12.35 | 11.16 | 10.18 | 9.28 | 8.04 |

The bottle 1 of Comparative Example 1 had a configuration in which no rib 26 is formed in the bottom wall portion 19. The bottle 1 of Comparative Example 2 had a configuration in which no connection recess 26*b* is included in each rib 26. Therefore, in Table 1, the depth D1 of the main recess 26*a* and the depth D2 of the connection recess 26*b* in Comparative Example 1, and the depth D2 of the connection recess 26*b* of Comparative Example 2 were all 0.

Additionally, in the bottle 1 of Example 6, the depth D1 of the main recess 26*a* and the depth D2 of the connection recess 26*b* were made equal to each other. In the bottle 1 of Example 6, the ribs 26 are formed in the shape of grooves with equal depths regardless of their radial positions, and the bottom surfaces of the ribs 26 extend linearly in the radial direction in the vertical sectional view. In addition, in the respective bottles 1 of Comparative Examples 2 and 3 and Examples 1 to 5, the depth D1 of the main recesses 26*a* is equal to the curvature radius of the inner surfaces of the main recesses 26*a*.

As shown in Table 1, in the present analysis, in the respective bottles 1 of Comparative Examples 2 and 3 and Examples 1 to 6, the depth ratio D2/D1 was adjusted by changing the depth D2 of the connection recess 26*b* without changing the depth D1 of the main recess 26*a*.

In these respective bottles 1, comparison was made on the amounts of displacement of the centers of the bottom wall portions 19 of the movable wall portions 22 when setting the pressure reduction intensity to 20 kPa and absorptive capacities. Here, the amounts of displacement of the centers of the bottom wall portions 19 are the amounts of displacement of the bottom wall portions 19 directed above a portion located on the bottle axis O.

The analysis results of these amounts were respectively described in respective row of item names "Amount of Displacement of Center of Bottom Wall portion (mm)" and "Absorbing Capacity (ml)" of Table 1. The results of the absorptive capacities are further shown in a graph in FIG. 5. The plot located nearest to the left side among a plurality of plots shown on the graph shown in FIG. 5 show the results of Comparative Example 1, and the other plots show the respective results of Comparative Examples 2 and 3 and Examples 1, 2, 3, 4, 5, and 6 in order from the left side toward the right side.

From the above analysis results, in the bottles 1 of Examples 1 to 6, as shown in the row of the item name "Amount of Displacement of Center of Bottom Wall portion (mm)" of Table 1, it is confirmed that the movable wall portions 22 are greatly deformed, and specifically, the amounts of displacement of the centers of the bottom wall portions 19 are all equal to or greater than 5.0 mm. In addition, in these respective bottles 1, the movable wall portions 22 are also deformed into a reversed state.

Here, the depth ratio D2/D1 in the bottle 1 of Comparative Example 3 is 2/9 (22.2%), and the depth ratio D2/D1 in the bottle 1 of Example 6 is 1 (100%). Hence, it was confirmed from the present analysis that a large upward movement distance of the movable wall portion 22 at the time of decompression within the bottle 1 can be secured by the depth ratio D2/D1 being greater than 2/9 and equal to or smaller than 1.

Figure 5:
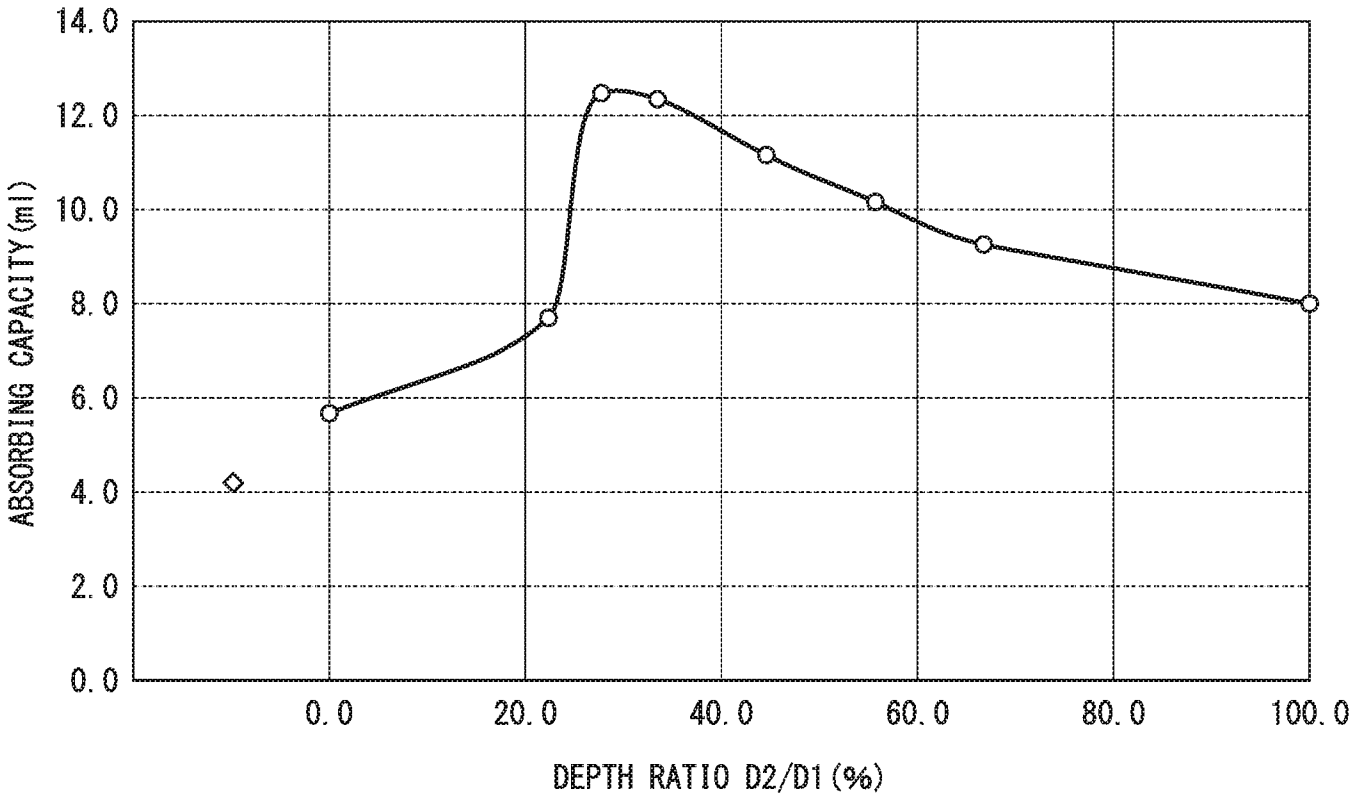
FIG. 5 is a graph showing results obtained by analyzing the influence that a depth ratio has on absorbing capacity.

Additionally, as shown in the row of the item name "Absorbing Capacity" of Table 1 and the graph of FIG. 5, in the bottles 1 of Examples 1 to 4, it was confirmed that 10.0 ml or greater of absorbing capacity is secured.

Here, the depth ratio D2/D1 in the bottle 1 of Example 1 is 2.5/9 (27.8%), and the depth ratio D2/D1 in the bottle 1 of Example 4 is 5/9 (55.6%). Hence, it was confirmed from the present analysis that the sufficient absorbing capacity can be secured by the depth ratio D2/D1 being equal to or greater than 2.5/9 and equal to or smaller than 5/9.

As described above, according to the bottle 1 related to the present embodiment, the depth ratio D2/D1 is made greater 2/9 and equal to or smaller than 1. Accordingly, it is possible to secure a large upward movement distance of the movable wall portion 22 at the time of decompression within the bottle 1, and the pressure reduction-absorbing performance within the bottle 1 can be improved. That is, in a case where the depth ratio D2/D1 is equal to or smaller than 2/9, it may become difficult to greatly displace the movable wall portion 22 in the direction of the bottle axis O at the time of decompression within the bottle 1.

In addition, in such a configuration that the movable wall portion 22 gradually extends downward from the radial outer side toward the radial inner side as in the present embodiment, in a case where the depth ratio D2/D1 is made greater than 2/9 and equal to or smaller than 1, the movable wall portion 22 can be greatly deformed in the direction of the bottle axis O at the time of decompression within the bottle 1, for example, the movable wall portion 22 can be deformed into a reversed state in the direction of the bottle axis O.

Additionally, in a case where the depth ratio D2/D1 is made smaller than 1, the main recess 26*a* can be formed more deeply than the connection recess 26*b*. Accordingly, when the inside of the bottle 1 is brought into a decompressed state, the movable wall portion 22 can be effectively moved upward so that the pressure reduction-absorbing performance within the bottle 1 is further improved.

Moreover, in a case where the depth ratio D2/D1 is made equal to or greater than 2.5/9 and equal to or smaller than 5/9, the movable wall portion 22 can be more effectively moved upward so that the pressure reduction-absorbing performance within the bottle 1 is reliably improved.

In addition, the technical scope of the invention is not limited to the above embodiment, and various changes can be made without departing from the concept of the invention.

In the above embodiment, the bottom central portion 30 includes the recessed circumferential wall portion 23 and the top wall 24. However, the invention is not limited to this. For example, the bottom central portion 30 may have a flat plate shape that has a circular shape in a plan view. Moreover, the bottom central portion 30 may have a curved plate shape that protrudes in the direction of the bottle axis O in the vertical sectional view.

Moreover, in the above embodiment, the inner surface of the connection recess 26*b* is formed in the shape of a convex surface in the vertical sectional view. However, the invention is not limited to this. For example, in the vertical sectional view, the inner surface of the connection recess 26*b* may be formed in the shape of a concavely curved surface part or may be formed in a planar shape.

Additionally, for example, an appropriately change, such as extending the rising circumferential wall portion 21 in parallel along the direction of the bottle axis O, can be made.

Also, for example, appropriate changes, such as making the movable wall portion 22 protrude in parallel in the radial direction and extending the movable wall portion 22 gradually upward from the radial outer side toward the radial inner side, can be made.

In addition, in the above embodiment, the recessed circumferential wall portion 23 is gradually increased in diameter downward from above. However, the invention is not limited to this. For example, appropriate changes, such as making the recessed circumferential wall portion 23 equal in diameter over the entire length in the direction of the bottle axis O can be made.

Moreover, it is not necessary to form the uneven portion 17*a*.

Additionally, the synthetic resin material for forming the bottle 1 may be appropriately changed to, for example, polyethylene terephthalate, polyethylene naphthalate, amorphous polyester, or the like, or blend materials thereof.

Moreover, the bottle 1 is not limited to a single-layer structure, and may be a laminated structure having an intermediate layer. This intermediate layer includes, for example, a layer made of a resin material having a gas barrier property, a layer made of a recycled material, or a layer made of a resin material having oxygen absorbability.

In the above embodiment, the shape of each of the shoulder portion 12, the body portion 13, and the bottom portion 14 in the horizontal sectional view orthogonal to the bottle axis O is a circular shape. However, the invention is not limited to this. For example, the above shape may be appropriately changed to a polygonal shape or the like.

In addition, the constituent elements in the above embodiment can be substituted with well-known constituent elements without departing from the concept of the invention, and the above embodiment may be appropriately combined together.

INDUSTRIAL APPLICABILITY

According to the bottle of the invention, the pressure reduction-absorbing performance within the bottle can be improved.

REFERENCE SIGNS LIST

1: BOTTLE
14: BOTTOM PORTION
18: GROUNDING PORTION
19: BOTTOM WALL PORTION
21: RISING CIRCUMFERENTIAL WALL PORTION
22: MOVABLE WALL PORTION
23: RECESSED CIRCUMFERENTIAL WALL PORTION
25: CURVED SURFACE PART (CONNECTED PORTION TO RISING CIRCUMFERENTIAL WALL PORTION)
26: RIB
26*a*: MAIN RECESS
26*b*: CONNECTION RECESS
O: BOTTLE AXIS

The invention claimed is:

1. A bottle formed of a synthetic resin material and having a bottomed cylindrical shape, the bottle comprising:

a bottom wall portion of a bottom portion, the bottom wall portion including:

a grounding portion that is located at an outer circumferential edge of the bottle, a rising circumferential wall portion that is continuous with the grounding portion on a radially inner side of the grounding portion and that extends upward, and a movable wall portion that protrudes from an upper end of the rising circumferential wall portion on a radially inner side of the rising circumferential wall portion, wherein:

a connected portion connects the rising circumferential wall portion with the movable wall portion, the movable wall portion is movable upward around the connected portion, a plurality of ribs are radially disposed around a bottle axis on the movable wall portion, the ribs include a plurality of main recesses, which are each recessed upward, and a connection recess, the main recesses of the plurality of main recesses are arranged at predetermined intervals in a radial direction of the bottle, the connection recess connects adjacent main recesses of the plurality of main recesses that are adjacent to each other in the radial direction of the bottle, a bottom surface of the connection recess is convex toward a bottom side of the bottle, and a depth ratio D2/D1 is greater than 2/9 and less than 1 such that D2 is a depth of the connection recess and D1 is a depth of each main recess of the plurality of recesses.

2. The bottle according to claim 1, wherein the depth ratio D2/D1 is equal to or greater than 2.5/9 and equal to or smaller than 5/9.

* * * * *